US011434791B2

(12) United States Patent
Harada et al.

(10) Patent No.: US 11,434,791 B2
(45) Date of Patent: Sep. 6, 2022

(54) OIL LEVEL GAUGE GUIDE APPARATUS

(71) Applicant: Honda Motor Co., Ltd., Tokyo (JP)

(72) Inventors: Toru Harada, Wako (JP); Ryosuke Hayashi, Wako (JP); Takashi Asami, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 38 days.

(21) Appl. No.: 17/140,063

(22) Filed: Jan. 2, 2021

(65) Prior Publication Data

US 2021/0207504 A1 Jul. 8, 2021

(30) Foreign Application Priority Data

Jan. 6, 2020 (JP) ..... JP2020-000080

(51) Int. Cl.
*F01M 11/12* (2006.01)

(52) U.S. Cl.
CPC ..... *F01M 11/12* (2013.01)

(58) Field of Classification Search
CPC .... G01F 23/04; F01M 11/12; F01M 11/0004; F01M 11/02; F02F 7/0065
See application file for complete search history.

(56) References Cited

U.S. PATENT DOCUMENTS 4,330,940 A * 5/1982 Leitgeb ..... G01F 23/04 33/729
10,648,378 B2 * 5/2020 Demeulenaere ... F01M 11/0004
2003/0121168 A1 * 7/2003 Matsumoto ..... G01F 23/04 33/726
2008/0028630 A1 * 2/2008 Cho ..... F01M 11/0004 33/726
2010/0154237 A1 * 6/2010 Amiri ..... G01F 23/04 33/726
2018/0238206 A1 * 8/2018 Demeulenaere ..... G01F 23/04

FOREIGN PATENT DOCUMENTS

JP 2005273786 A 10/2005
JP 2007120407 A 5/2007
JP 2015063906 A * 4/2015
JP 2015063906 A 4/2015
JP 2015102042 A * 6/2015

OTHER PUBLICATIONS

Japanese Office Action; Application 2020-000080; dated Jul. 13, 2021.

* cited by examiner

*Primary Examiner* — Kurt Philip Liethen
(74) *Attorney, Agent, or Firm* — Duft & Bornsen, PC

(57) ABSTRACT

An oil level gauge guide apparatus including a body of an internal combustion engine, a case member attached to the body so as to cover a moving part disposed on a side of the body, a passage forming member forming a gauge passage through which an oil level gauge passes between the body and the case member, and a guide portion provided at a lower part of the passage forming member to guide the oil level gauge to the gauge passage. The body and the case member include a first and second facing surfaces facing each other so as to form a space to accommodate the moving part and the guide portion is extended along the gauge passage and protruded from one of the first facing surface and the second facing surface to the other of the first facing surface and the second facing surface.

7 Claims, 6 Drawing Sheets

OIL LEVEL GAUGE GUIDE APPARATUS

CROSS-REFERENCE TO RELATED APPLICATION

This application is based upon and claims the benefit of priority from Japanese Patent Application No. 2020-000080 filed on Jan. 6, 2020, the content of which is incorporated herein by reference.

BACKGROUND OF THE INVENTION

Field of the Invention

This invention relates to an oil level gauge guide apparatus configured to guide an oil level gauge to an oil pan.

Description of the Related Art

Conventionally, as an apparatus, there is a known apparatus configured to guide an oil level gauge to an oil pan by inserting the oil level gauge into a tubular guide. Such an apparatus is described, for example, in Japanese Unexamined Patent Publication No. 2007-120407 (JP2007-120407A). In the apparatus described in JP2007-120407A, in order to smoothly insert the oil level gauge into the tubular guide, a gauge portion of the oil level gauge is connected to a grasped portion of the oil level gauge so as to be rotatable around the longitudinal direction of the gauge portion.

However, since the apparatus described in JP2007-120407A includes the tubular guide, the layout is greatly constrained. On the other hand, when a passage for the oil level gauge is formed in the existing space, the tip of the oil level gauge may interfere with various parts, and there is a problem in the insertability of the oil level gauge.

SUMMARY OF THE INVENTION

An aspect of the present invention is an oil level gauge guide apparatus configured to guide an oil level gauge to an oil pan. The oil level gauge guide apparatus includes: a body of an internal combustion engine; a case member attached to the body so as to cover a moving part disposed on a side of the body; a passage forming member configured to form a gauge passage through which the oil level gauge passes between the body and the case member; and a guide portion provided at a lower part of the passage forming member so as to guide the oil level gauge to the gauge passage. The body and the case member include a first facing surface and a second facing surface facing each other so as to form a space to accommodate the moving part, respectively, and the guide portion is extended along the gauge passage and protruded from one of the first facing surface and the second facing surface to the other of the first facing surface and the second facing surface.

BRIEF DESCRIPTION OF THE DRAWINGS

The objects, features, and advantages of the present invention will become clearer from the following description of embodiments in relation to the attached drawings, in which.

DETAILED DESCRIPTION OF THE INVENTION

Hereafter, an embodiment of the present invention is explained with reference to FIGS. 1 to 6. An oil level gauge guide apparatus according to the embodiment of the present invention includes a level gauge passage that guides an oil level gauge toward an oil pan. The level gauge passage is disposed in an engine (an internal combustion engine).

Figure 1:
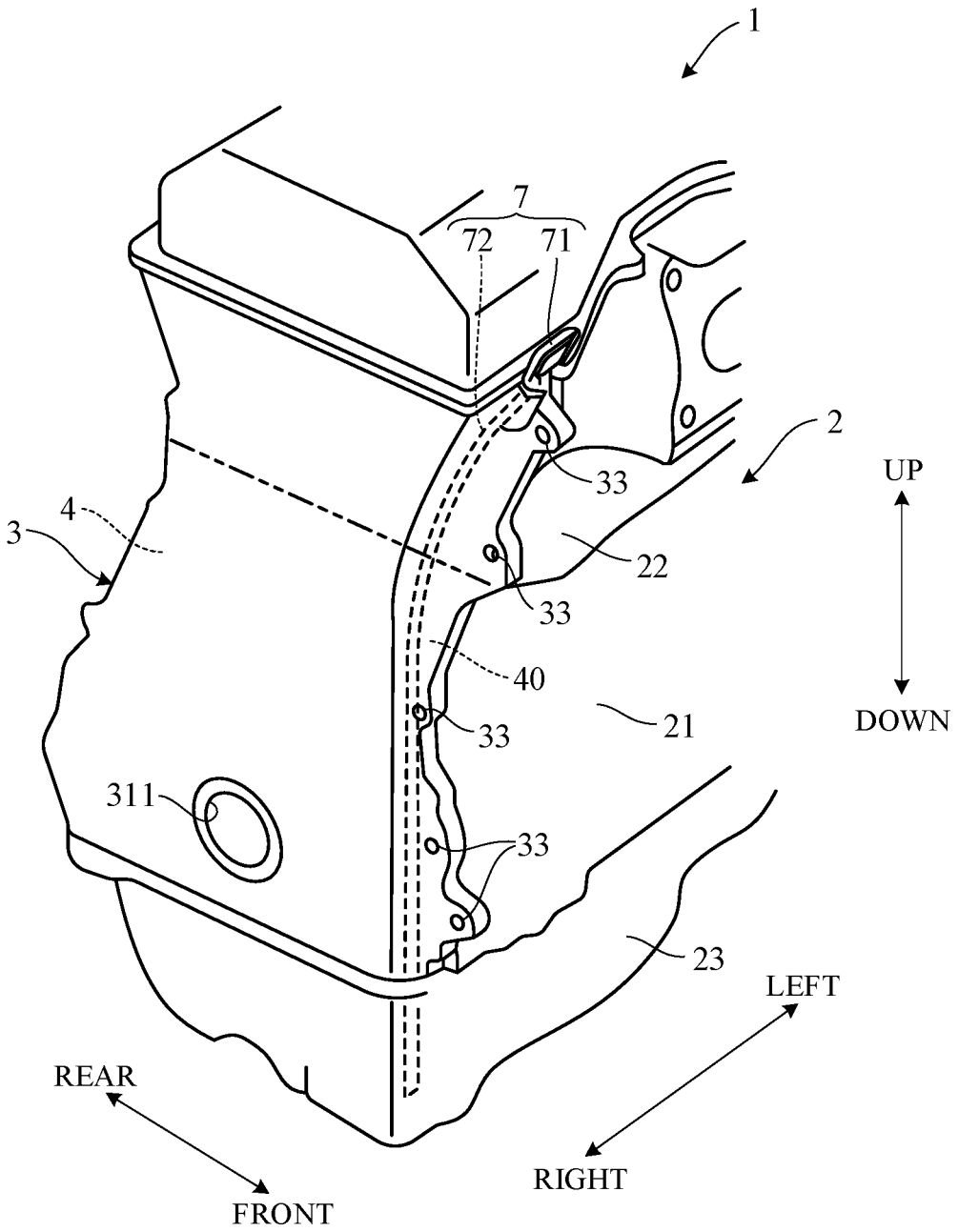
FIG. 1 is a perspective view showing the configuration of main components of an engine 1 in which an oil level gauge guide apparatus according to the embodiment of the present invention is disposed.

FIG. 1 is a perspective view showing the configuration of main components of an engine 1 in which the oil level gauge guide apparatus according to the embodiment of the present invention is disposed. For convenience, the front-rear direction, up-down direction, and left-right direction (width direction) are defined as shown in the drawings. The configuration of the components will be described in accordance with this definition. For example, the down direction of the up-down direction corresponds to the gravity direction. To be exact, the up-down direction corresponds to the direction in which the cylinder of the engine 1 extends (the direction along an axis L in FIG. 2).

As shown in FIG. 1, the engine 1 includes an engine body 2 (internal combustion engine body) and a case member 3 that forms a housing chamber (housing space) 4 on a side of the engine body 2 by covering a side surface 20 (FIG. 2), which is the right end surface of the engine body 2. An oil level gauge 7 used to visually detect the amount of engine oil or the degree of degradation thereof is detachably disposed on the engine 1.

The engine body 2 includes a cylinder block 21, a cylinder head 22 mounted on the upper surface of the cylinder block 21, and an oil pan 23 mounted on the lower surface of the cylinder block 21.

Figure 2:
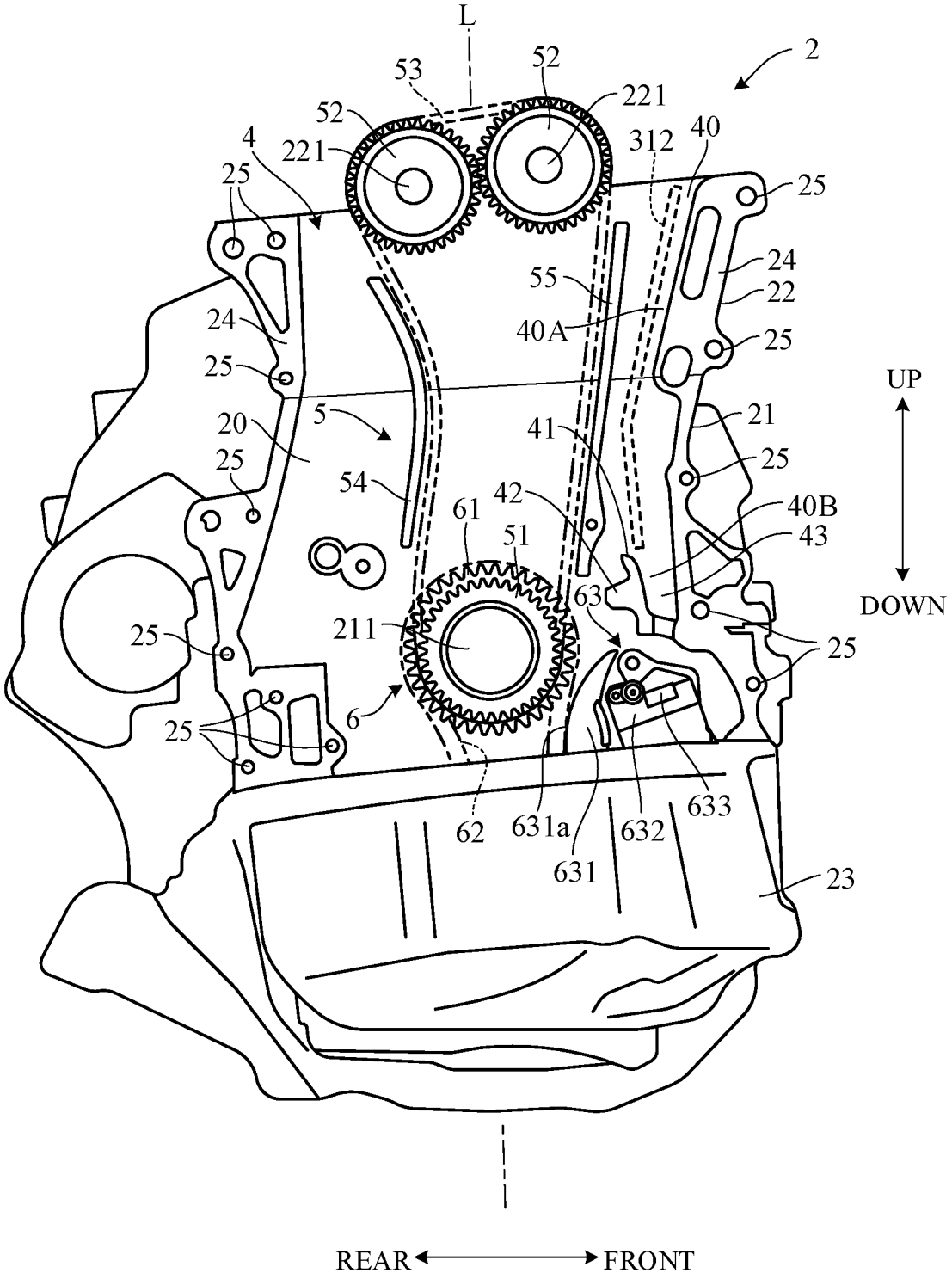
FIG. 2 is a side view showing the configuration of a right surface of an engine body in a state in which a case member is removed from the engine 1 of FIG. 1.
Figure 3:
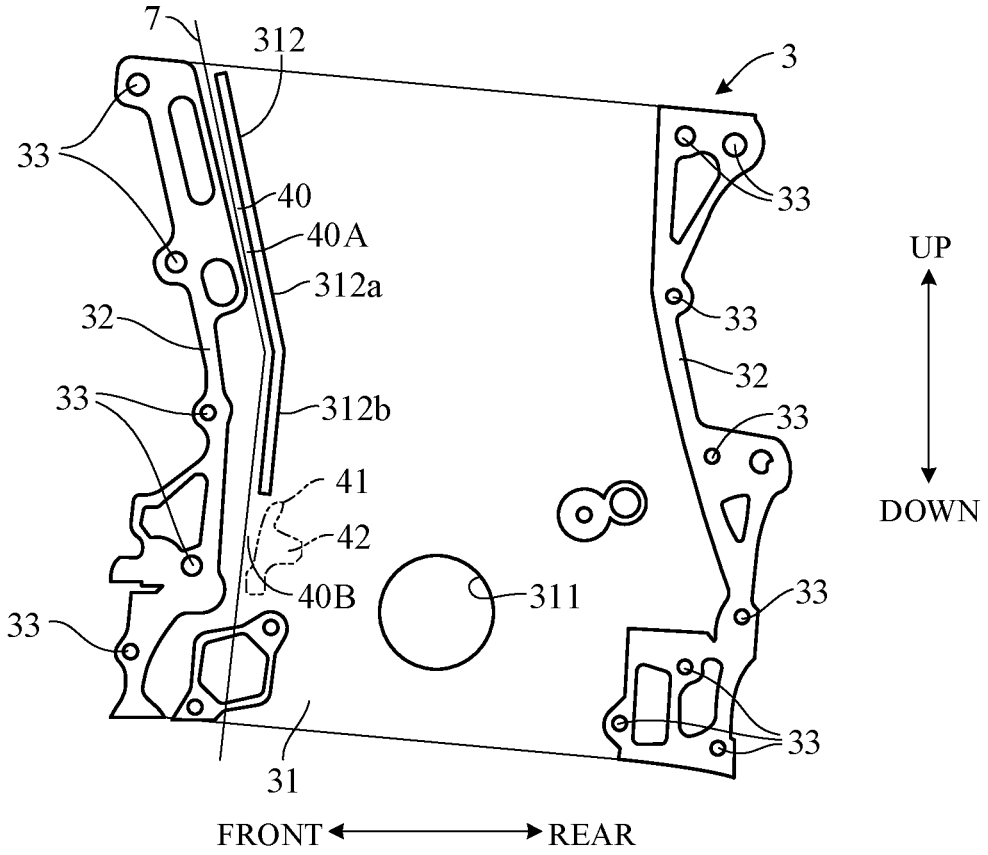
FIG. 3 is a front view showing an internal configuration of the case member alone.

FIG. 2 is a side view showing the configuration of the right surface of the engine body 2 in a state in which the case member 3 is removed from the engine 1 of FIG. 1 (a drawing of the engine body 2 seen from the right side) and is a drawing showing the internal configuration of the housing chamber 4. FIG. 3 is a front view showing the internal configuration of the case member 3 alone (a drawing of the case member 3 seen from the left side).

The case member 3 shown in FIG. 3 is mounted on the side surface 20 of the engine body 2 shown in FIG. 2. Thus, the housing chamber 4 extending from the cylinder head 22 to the oil pan 23 is formed between the side surface 20 of the engine body 2 and the counter surface 31 of the case member 3. As shown in FIG. 2, the housing chamber 4 houses a timing train mechanism 5 and an oil pump drive mechanism 6. The housing chamber 4 includes a level gauge passage 40 that extends to the oil pan 23 approximately in the up-down direction and through which the oil level gauge 7 passes.

A pair of front and rear side edges 24, 24 that swell rightward are disposed on the front and rear ends of the side surface 20 of the engine body 2. The timing train mechanism 5 and the oil pump drive mechanism 6 are disposed inside the pair of front and rear side edges 24, 24. The pair of front and rear side edges 24, 24 extend in the up-down direction and form flat flange surfaces. The pair of front and rear side edges 24, 24 are provided with multiple through holes 25 into which multiple bolts (not shown) can be inserted. The bolts are used to mount the case member 3 on the side surface 20 of the engine body 2.

The timing train mechanism 5 includes a first crank sprocket 51, a pair of cam sprockets 52, 52, a timing chain 53, and a tensioner 54.

The first crank sprocket 51 is mounted on the right end of a crankshaft 211 that extends in the left-right direction in a lower portion of the cylinder block 21. More specifically, the crankshaft 211 protrudes rightward from the side surface 20 by a predetermined amount and is rotatably supported through a bearing. The first crank sprocket 51 is mounted on the end of the crankshaft 211 coaxially with the crankshaft 211.

The pair of cam sprockets 52, 52 are mounted on a pair of front and rear camshafts 221, 221 for intake and exhaust that extend in the left-right direction above the cylinder head 22. More specifically, the pair of front and rear camshafts 221, 221 protrude rightward from the side surface 20 by a predetermined amount and are rotatably supported through bearings. The pair of cam sprockets 52, 52 are mounted on ends of the pair of front and rear camshafts 221 coaxially with the camshafts 221, 221.

The timing chain 53 forms a moving part disposed on a side of the engine body 2. The timing chain 53 is an endless transmission belt and is wound around the first crank sprocket 51 and the pair of cam sprockets 52, 52 so as to be engaged therewith. Thus, rotation of the crankshaft 211 is transmitted to the pair of cam sprockets 52, 52 through the timing chain 53, resulting in rotation of the pair of front and rear camshafts 221, 221 synchronous with the rotation of the crankshaft 211.

The tensioner 54 is disposed between the first crank sprocket 51 and the rear cam sprocket 52 so as to face the timing chain 53. The tensioner 54 guides the timing chain 53 while applying a predetermined pressing force to the timing chain 53 from the rear of the timing chain 53 and thus giving predetermined tension to the timing chain 53.

A chain guide 55 is disposed between the first crank sprocket 51 and the front cam sprocket 52 so as to face the timing chain 53. The chain guide 55 guides the timing chain 53 while regulating forward movement of the timing chain 53.

Although not shown, an oil pump is disposed in the oil pan 23. More specifically, the oil pump is disposed on the right side of the side surface 20 of the engine body 2 so as to be adjacent to an oil storage chamber (not shown) in the oil pan 23 storing engine oil. The oil pump drive mechanism 6 includes a second crank sprocket 61, the oil pump, a timing belt 62, and a tensioner 63.

The second crank sprocket 61 is mounted on the right end of the crankshaft 211 coaxially with the crankshaft 211. The second crank sprocket 61 is disposed on the left side of the first crank sprocket 51 and rotates integrally with the first crank sprocket 51.

The timing belt 62 is wound around the second crank sprocket 61 and an oil pump drive shaft (not shown). Thus, rotation of the crankshaft 211 is transmitted through the timing belt 62 to the oil pump (not shown), which is then driven synchronously with the rotation of the crankshaft 211.

The tensioner 63 is disposed between the second crank sprocket 61 and the oil pump (not shown) below the chain guide 55 so as to face the timing belt 62. The tensioner 63 guides the timing belt 62 while applying a predetermined pressing force to the timing belt 62 from the front of the timing belt 62 and thus giving predetermined tension to the timing belt 62.

More specifically, the tensioner 63 includes a pressing portion 631 that presses the timing belt 62 and a drive portion 632 that drives the pressing portion 631 in the front-rear direction. The pressing portion 631 has a pressing surface 631*a* curved along the timing belt 62 and presses the front surface of the timing belt 62 through the pressing surface 631*a*. The drive portion 632 is disposed in the front of the pressing portion 631 and is mounted on the side surface 20 of the engine body 2. The drive portion 632 includes a slidable piston that drives the pressing portion 631 approximately in the front-rear direction. The drive portion 632 is located on an extension of the level gauge passage 40 in a side view.

As shown in FIG. 3, the counter surface 31 (left surface) of the case member 3 opposed to the side surface 20 of the engine body 2 has a concave shape. The housing chamber 4 for storing the timing train mechanism 5, oil pump drive mechanism 6, and the like is formed between the side surface 20 of the engine body 2 and the counter surface 31. The case member 3 also includes a pair of front and rear side edges 32, 32 that swell from the counter surface 31 toward the side surface 20 of the engine body 2 and extend approximately in the up-down direction.

A belt-shaped guide 312 that extends over a predetermined range in the up-down direction near the front side edge 32 and has a predetermined height (the length in the left-right direction) is disposed on the counter surface 31 of the case member 3 so as to protrude. A clearance is formed between the side edge 32 and the belt-shaped guide 312 so as to extend over the entire length of the belt-shaped guide 312, and the level gauge passage 40 is formed by this clearance.

An approximately circular through hole 311 is provided in the central portion in the front-rear direction of a lower portion of the counter surface 31. The right end of the crankshaft 211 is inserted in the through hole 311.

The pair of front and rear side edges 32, 32 extend in the up-down direction so as to correspond to the pair of front and rear side edges 24, 24 of the engine body 2. The pair of front and rear side edges 32, 32 are provided with multiple through holes 33 into which multiple bolts can be inserted. The case member 3 is fixed to the engine body 2 by inserting bolts into the through holes 33 of the case member 3 and the through holes 25 of the engine body 2 and fastening nuts to the bolts.

The front side edge 32 is formed so as to be bent forward at an approximately central portion thereof in the up-down direction. The belt-shaped guide 312 is bent so as to correspond to the shape of the side edge 32. That is, the belt-shaped guide 312 includes an inclined portion 312*a* that extends so as to be inclined downward and rearward and an inclined portion 312*b* that is connected to the inclined portion 312*a* and extends so as to be inclined downward and forward. Thus, the level gauge passage 40 is formed so as to be bent.

In FIG. 2, the position of the belt-shaped guide 312 with the case member 3 mounted on the engine body 2 is shown by a dotted line. As shown in FIG. 2, the belt-shaped guide 312 is disposed so as to be located in front of the chain guide 55 when the case member 3 is mounted, that is, so as to be located between the chain guide 55 and the front side edge 32. The lower end of the belt-shaped guide 312 is located above the crankshaft 211 and the tensioner 63. Also, the lower end of the belt-shaped guide 312 is located in a higher position than the lower end of the chain guide 55. The lower end of the chain guide 55 is located in a higher position than the position in which the timing chain 53 is wound around the first crank sprocket 51.

FIG. 1 shows a state in which the oil level gauge 7 is inserted in the level gauge passage 40 until reaching the lowermost portion. As shown in FIG. 1, the oil level gauge 7 includes a grasped portion 71 grasped by an operator and a gauge portion 72 that extends downward from the grasped portion 71. The gauge portion 72 consists of an elastically deformable, long, metal, rod-shaped member and has approximately rectangular flat cross-section over the entire length, the cross-section having the length (width) in the left-right direction longer than the length (thickness) in the front-rear direction. The oil level gauge 7 is inserted into the level gauge passage 40 from an opening disposed in an upper portion of the engine 1 until reaching the oil storage chamber in the oil pan 23.

When the oil level gauge 7 is inserted until reaching the oil storage chamber, the tip of the oil level gauge 7 enters the oil storage chamber by a predetermined length. By pulling out the oil level gauge 7 in this state, the amount of engine oil stored in the oil storage chamber can be identified from the position of oil adhering to the tip. Also, the degree of degradation of engine oil (whether replacement is required) can be identified from the quality (color, etc.) of the adhering oil.

As shown in FIG. 2, in the present embodiment, the level gauge passage 40 is formed so as to be bent downward. Also, the lower end of the belt-shaped guide 312 is located in a higher position than the lower end of the chain guide 55. For this reason, when the tip of the gauge portion 72 of the oil level gauge 7 is inserted downward beyond the lower end of the belt-shaped guide 312, the tip of the gauge portion 72 may shift toward the first and second crank sprockets 51 and 61, that is, rearward. As a result, the tip of the gauge portion 72 may interfere with the first and second crank sprockets 51 and 61. To prevent the tip of the gauge portion 72 from interfering with the first and second crank sprockets 51 and 61, the oil level gauge guide apparatus according to the present embodiment is configured as follows.

Figure 4:
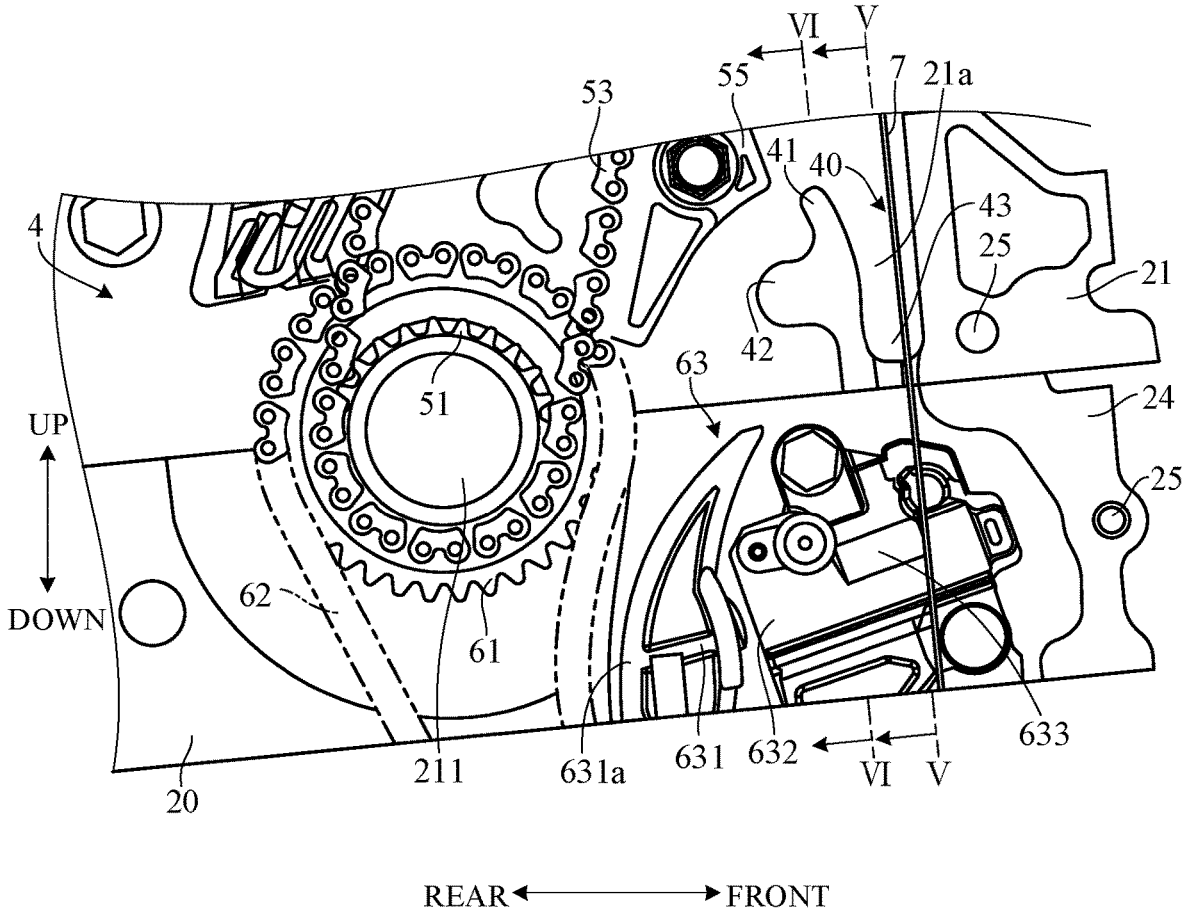
FIG. 4 is an enlarged view of FIG. 2.

FIG. 4 is an enlarged view of main components of FIG. 2. As shown in FIGS. 2 and 4, a guide 41 that guides the inserted oil level gauge 7 to the level gauge passage 40 is disposed below the belt-shaped guide 312 on the side surface 20 of the engine body 2. The guide 41 is able to prevent the tip of the oil level gauge 7 inserted into the level gauge passage 40 from shifting toward the first and second crank sprockets 51 and 61. Note that in FIG. 3, the position of the guide 41 with the case member 3 mounted on the engine body 2 is shown by a dotted line.

The guide 41 protrudes rightward from the side surface 20 of the engine body 2 toward the counter surface 31 of the case member 3. The guide 41 also extends in the up-down direction along the level gauge passage 40, forming a convex portion extending in the up-down direction. The guide 41 protrudes such that the right end surface thereof is in contact with the counter surface 31 of the case member 3. Due to the contact of the right end surface of the guide 41 with the counter surface 31, the guide 41 is able to suppress a vibration generated on the side surface 20 or case member 3.

A cylinder 42 is disposed near the guide 41 on the side surface 20 of the engine body 2 so as to protrude rightward. The cylinder 42 is a thick rib disposed to increase the stiffness of the side surface 20. The guide 41 is formed integrally with the cylinder 42 so as to connect to the cylinder 42. The guide 41 may be formed integrally with a rib different from the cylinder 42 so that the stiffness of the guide 41 is increased.

As shown in FIGS. 2 and 3, the guide 41 is disposed such that the upper end thereof is adjacent to the lower end of the belt-shaped guide 312 with the case member 3 mounted on the engine body 2. This configuration is able to prevent the oil level gauge 7 from passing through the clearance between the lower end of the belt-shaped guide 312 and the upper end of the guide 41 and thus to prevent the tip of the oil level gauge 7 from interfering with the first and second crank sprockets 51 and 61.

As shown in FIGS. 2 and 3, the belt-shaped guide 312 along with the guide 41 forms the level gauge passage 40 through which the oil level gauge 7 passes, between the front side edges 24 and 32 of the engine body 2 and case member 3. A level gauge passage formed by the belt-shaped guide 312 is referred to as a first level gauge passage 40A, and a level gauge passage formed by the guide 41 is referred to as a second level gauge passage 40B. The first level gauge passage 40A and second level gauge passage 40B are continuously formed in the up-down direction, and the oil level gauge 7 is inserted into the passages 40A and 40. As shown in FIG. 3, the first level gauge passage 40A is formed so as to be bent in a side view and, on the other hand, the second level gauge passage 40B is formed so as to be approximately linear in a side view.

Figure 5:
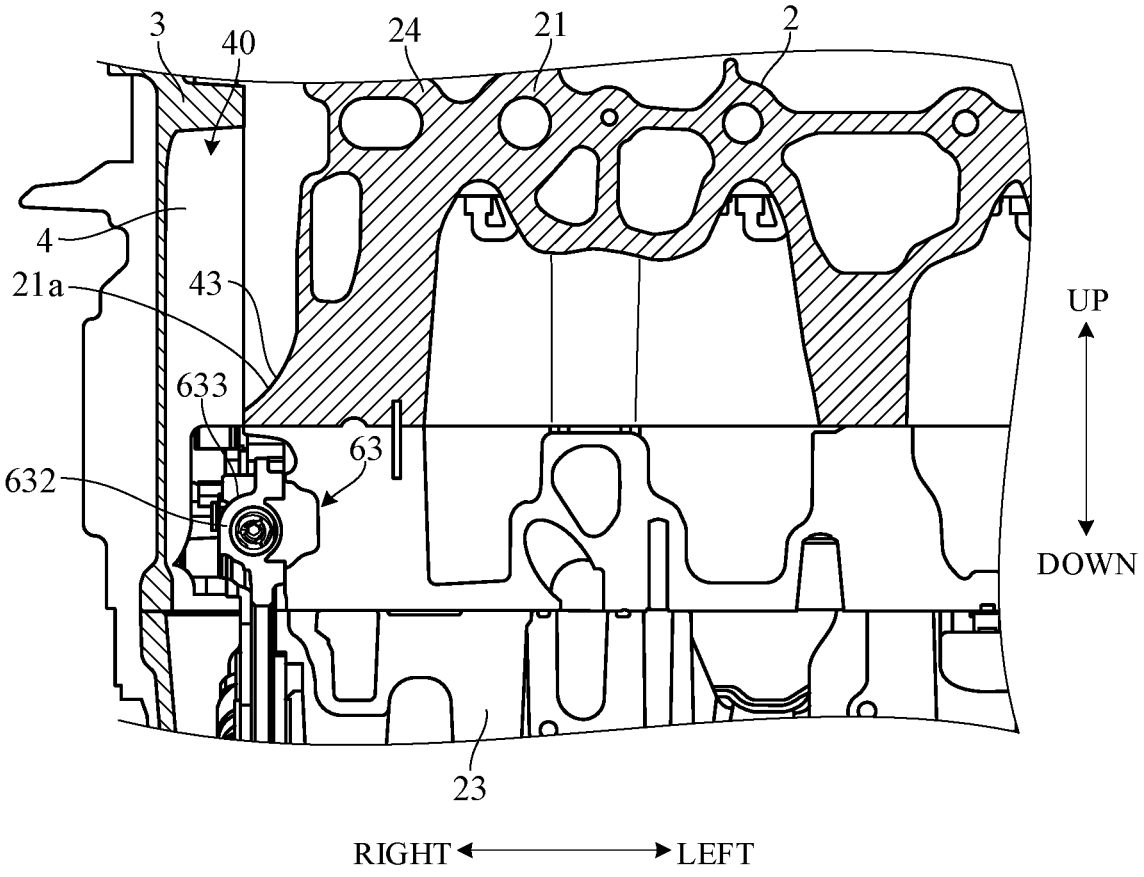
FIG. 5 is a sectional view taken along line V-V of FIG. 4.

FIG. 5 is a sectional view taken along the level gauge passage 40 in front of the guide 41 with the case member 3 mounted on the engine body 2 (a sectional view taken along line V-V of FIG. 4). As shown in FIGS. 4 and 5, a swelling portion 21*a* that connects to the guide 41 and swells rightward is disposed in front of the guide 41 on the side surface 20 of the engine body 2. The right surface of the swelling portion 21*a* is provided with an inclined surface 43 that is inclined downward and rightward (referred to as a "first inclined surface"). The first inclined surface 43 is located on an extension of the second level gauge passage 40B in a side view (see FIG. 2). As shown in FIG. 5, the first inclined surface 43 is in the shape of a gentle concave curved surface rather than a flat surface.

When the oil level gauge 7 is inserted and the tip thereof moves to the side surface 20 side (left side) and contacts the first inclined surface 43, the first inclined surface 43 is able to guide the oil level gauge 7 to the level gauge passage 40 on the right side of the cylinder block 21. In particular, the first inclined surface 43 is in the shape of a concave curved surface and thus is able to smoothly move the oil level gauge 7 to the level gauge passage 40 on the right side of the cylinder block 21.

A drive portion 632 of the tensioner 63 is located below the first inclined surface 43. The drive portion 632 includes a moving portion and a non-moving portion (e.g., case). The right surface of the case of the drive portion 632 is provided with an inclined surface 633 that is inclined downward and rightward (referred to as a "second inclined surface"). The second inclined surface 633 is formed so as to be offset to the right with respect to the first inclined surface 43. Thus, when the tip of the oil level gauge 7 contacts the drive portion 632, the second inclined surface 633 of the drive portion 632 is able to easily guide the oil level gauge 7 to a deeper portion of the level gauge passage 40 without hampering insertion of the oil level gauge 7.

Next, an example of the operation of the oil level gauge guide apparatus thus configured will be described. When inserting the oil level gauge 7 into the level gauge passage 40, the oil level gauge 7 is inserted into the housing chamber 4 from the opening disposed in the upper portion of the engine 1. The oil level gauge 7 inserted into the housing chamber 4 moves downward through the level gauge passage 40 on the front side of the housing chamber 4, that is, along the belt-shaped guide 312. The tip of the oil level gauge 7 contacts the bent portion of the belt-shaped guide 312 partway through, changes its direction to the forward direction, and moves downward along the belt-shaped guide 312.

When the oil level gauge 7 moves to a lower position than the lower end of the belt-shaped guide 312, the tip of the oil level gauge 7 is guided to the guide 41. Thus, the tip of the oil level gauge 7 moves downward through the level gauge passage 40 without moving toward the first and second crank sprockets 51 and 61. At this time, the tip of the oil level gauge 7 moves downward while shifting rightward along the first inclined surface 43 of the side surface 20 of the engine body 2 and the second inclined surface 633 therebelow. As seen above, the oil level gauge guide apparatus is able to easily guide the tip of the oil level gauge 7 to the oil pan 23 while causing the tip of the oil level gauge 7 to bypass the drive portion 632 present on an extension of the level gauge passage 40.

The present embodiment can achieve advantages and effects such as the following:

(1) The oil level gauge guide apparatus is configured to guide an oil level gauge provided at the engine 1 to an oil pan (FIG. 1). More specifically, the oil level gauge guide apparatus includes an engine body 2; a case member 3 attached to the engine body 2 so as to cover a moving part such as a timing chain 53 disposed on a side of the engine body 2; a belt-shaped guide 312 forming a level gauge passage 40 through which the oil level gauge 7 passes between the engine body 2 and the case member 3; and a guide 41 (a guide portion) provided at a lower part of the belt-shaped guide 312 so as to guide the oil level gauge 7 to the level gauge passage 40 (FIG. 2). The engine body 2 and the case member 3 include a side surface 20 and a counter surface 31 facing each other so as to form a housing chamber 4 (space) to accommodate the timing chain 53, respectively (FIGS. 2 and 3). The guide 41 is extended along the level gauge passage 40 and protruded from one of the side surface 20 to the counter surface 31 of the case member 3 (FIG. 2).

In the present embodiment, the housing chamber 4 formed between the side surface 20 of the engine body 2 and the counter surface 31 of the case member 3, that is, the existing space in the engine 1 is used as the level gauge passage 40. Thus, the insertability of the oil level gauge 7 can be improved.

On the other hand, for example, if a tubular guide into which an oil level gauge can be inserted is joined to an oil pan from the outside of the engine and the oil level gauge is guided to the oil pan using the tubular guide, the tubular guide may be broken due to a vibration of the engine or oil may leak from the junction of the tubular guide and oil pan. Also, joining the tubular guide to the oil pan involves an increase in the number of parts or the number of mounting steps, leading to an increase in the engine production cost. Also, if the tubular guide is directly joined to the oil pan, consideration must be taken to the disposition of the parts joined to the engine or the disposition of the parts joined to the vehicle body, that is, the layout is greatly constrained.

If the existing space in the engine is formed as the level gauge passage through which the oil level gauge is guided to the oil pan, it is preferred to dispose this passage in the housing chamber that is disposed on a side of the engine and houses the timing chain and the like (e.g., timing train chamber). However, if the level gauge passage is disposed in the housing chamber, the oil level gauge may interfere with the parts, such as the timing chain or rotor, before reaching the oil pan and thus may have difficulty in smoothly reaching the oil pan. In particular, if the direction in which the level gauge passage extends and the direction in which the oil level gauge is inserted into the housing chamber are different (for example, the level gauge passage is bent partway through), it is more difficult to cause the tip of the oil level gauge to smoothly reach the oil storage chamber in the oil pan.

In this regard, in the present embodiment, the level gauge passage 40 is disposed in the housing chamber 4 housing the timing chain 53 and the like, more specifically, in the clearance between the timing chain 53 and the front side edges 24 and 32. Also, the guide 41 is disposed between the level gauge passage 40 and timing chain 53 in order to prevent the tip of the oil level gauge 7 inserted into the level gauge passage 40 from deviating from the level gauge passage 40 partway through. This configuration is able to easily guide the oil level gauge 7 to the oil storage chamber in the oil pan 23.

(2) The oil level gauge guide apparatus further includes a cylinder 42 as a rib portion protruded from the side surface 20 of the engine body 2 (FIG. 2). The guide 41 is provided integrally with the cylinder 42, that is, continuously with the cylinder 42 for reinforcing (FIG. 4). Thus, the rigidity of the guide 41 can be easily increased without thickly forming the guide 41.

(3) The oil level gauge guide apparatus further includes a swelling portion 21*a* swelled from the side surface 20 of the engine body 2 to the counter surface 31 on the right side (FIG. 5). The swelling portion 21*a* includes a first inclined surface 43 (an inclined surface) downwardly inclined so as to guide the oil level gauge 7 to the level gauge passage 40 (FIG. 5). Therefore, the oil level gauge 7 can be easily inserted along the level gauge passage 40, which is narrowly formed at the inlet side and widened downward. In other words, even when the level gauge passage 40 is formed to be narrow halfway in order to avoid interference between the tip of the oil level gauge 7 and other components, the tip of the oil level gauge 7 can be easily guided to the level gauge passage 40.

(4) The first inclined surface 43 is provided continuously with the guide 41. More specifically, the first inclined surface 43 is formed on the front side of the guide 41 in a substantially recessed curved shape in cross-section (FIGS. 4 and 5). Thus, the oil level gauge 7 can be prevented from moving toward the first crank sprocket 51 (rearward) and the oil level gauge 7 can be easily guided to the level gauge passage 40.

(5) The oil level gauge guide apparatus further includes a drive portion 632 (a component) of a tensioner 63 attached to the side surface 20 of the engine body 2 and disposed below the swelling portion 21*a* in the housing chamber 4. The drive portion 632 includes a second inclined surface 633 downwardly inclined so as to guide the oil level gauge 7 to the level gauge passage 40 (FIGS. 4 and 5). Therefore, even when the tensioner 63 is protruded toward the level gauge passage 40, the oil level gauge 7 can be easily guided to the oil pan 23.

(6) The second inclined surface 633 provided at the drive portion 632 of the tensioner 63 is formed so as to offset from the first inclined surface 43 provided at the swelling portion 21*a* of the cylinder block 21 to the level gauge passage 40 side (rightward). Therefore, oil level gauge 7 can be smoothly move to the oil pan 23.

Figure 6:
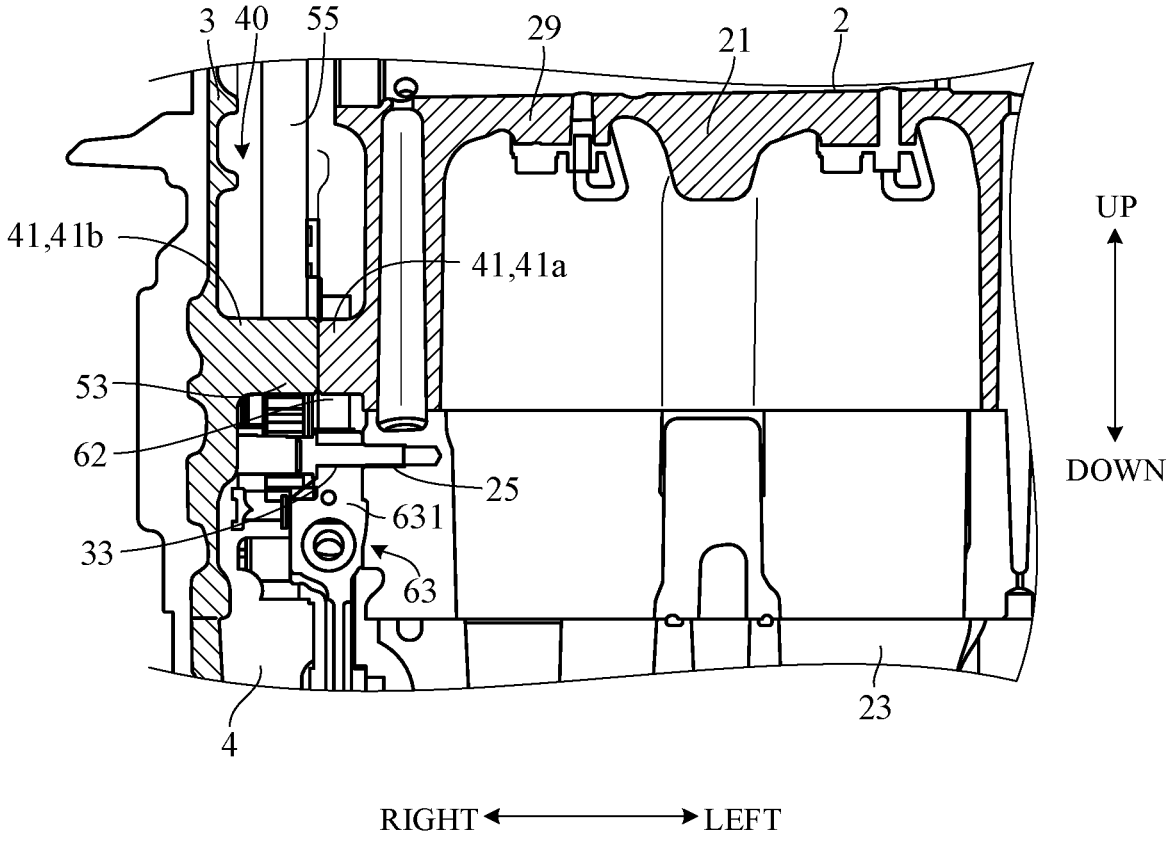
FIG. 6 is a diagram sowing a modification of the present embodiment.

In the above embodiment, the guide 41 is protruded from the side surface 20 of the engine body 2 (a first facing surface) rightward. However, a guide portion may be protruded from the counter surface 31 of the case member 3 (a second facing surface) or from both of the side surface 20 of the engine body 2 and the counter surface 31 of the case member 3. FIG. 6 is a diagram showing its example, and corresponds to a cross sectional view cut along VI-VI lines of FIG. 4. As shown in FIG. 6, the guide 41 includes a first guide portion 41*a* protruded from the side surface 20 of the engine body 2 rightward and a second guide portion 41*b* protruded from the counter surface 31 of the case member 3 leftward. The tip of the first guide portion 41*a* and the tip of the second guide portion 41*b* abut to each other. Optionally, the tips may be apart from each other. The first guide portion 41*a* may be formed integrally with a rib (for example, the cylinder 42) on the side surface 20 of the engine body 2 and the second guide portion 41*b* may be formed integrally with a rib on the counter surface 31 of the case member 3.

Although in the above embodiment, the guide 41 is provided integrally with the cylinder 42 (a rib) protruded from the side surface 20 of the engine body 2, the guide 41 may be provided integrally with another rib of the side surface 20 of the engine body 2.

In the above embodiment, the first inclined surface 43 is formed on the swelling portion 21*a* of the side surface 20 of the engine body 2 so as to incline downwardly and rightward. However, inclined surfaces may be provided on the side surface 20 and the counter surface 31. Although in the above embodiment, the timing chain 53 (a band-shaped member) is used as a moving part formed in a band-shape and extended in the up-down direction so as to transmit a torque output from the engine body 2, another moving part may be used.

Although in the above embodiment, the second inclined surface 633 is formed at the drive portion 632 of the tensioner 63, a second inclined surface may be formed at another component attached to the side surface 20 of the engine body 2 (a first facing surface) or the counter surface 31 of the case member 3 (a second facing surface), downwardly inclined so as to guide the oil level gauge to the oil level passage. In the above embodiment, the level gauge passage 40 through which the oil level gauge passes is formed between the engine body 2 and the case member 3 by the belt-shaped guide 312. However, the configuration of a passage forming member is not limited to this.

In the above embodiment, the guide 41 is protruded from the side surface 20 of the engine body 2 and the belt-shaped guide 312 is protruded from the counter surface 31 of the case member 3. In other words, a guide portion is protruded from a first facing surface and a passage forming member is protruded from a second facing surface. However, the guide portion may be protruded from the second facing surface and the passage forming member may be protruded from the first facing member. The guide portion and the passage forming member may be protruded from the first facing surface. The guide portion and the passage forming member may be protruded from the second facing surface.

The above embodiment can be combined as desired with one or more of the above modifications. The modifications can also be combined with one another.

According to the present invention, even when an existing space is used as a level gauge passage, an insertability of an oil level gauge can be improved.

Above, while the present invention has been described with reference to the preferred embodiments thereof, it will be understood, by those skilled in the art, that various changes and modifications may be made thereto without departing from the scope of the appended claims.

What is claimed is:

1. An oil level gauge guide apparatus configured to guide an oil level gauge to an oil pan, comprising:

a body of an internal combustion engine including a first facing surface;

a case member including a second facing surface facing the first facing surface and attached to the body so as to accommodate a moving part in a space between the first facing surface and the second facing surface;

a belt-shaped guide protruded from the second facing surface toward the first facing surface in a manner extended in a vertical direction to form a gauge passage through which the oil level gauge passes between the body and the case member;

a guide portion protruded from the first facing surface toward the second facing surface along the gauge passage between the belt-shaped guide and the moving part so as to guide the oil level gauge to the gauge passage; and a swelling portion swelled from the first facing surface toward the second facing surface and provided continuously with the guide portion; wherein the swelling portion is provided between a side edge of the body of the internal combustion engine swelled toward the second facing surface and the guide portion and includes an inclined surface inclined downward and toward the second facing surface from the first facing surface so as to guide the oil level gauge to the gauge passage.

2. The oil level gauge guide apparatus according to claim 1, wherein the gauge passage includes a first gauge passage formed by the belt-shaped guide, and a second gauge passage formed by the guide portion below the belt-shaped guide.

3. The oil level gauge guide apparatus according to claim 1, further comprising a rib portion protruded from the first facing surface toward the second facing surface, wherein the guide portion is provided integrally with the rib portion.

4. The oil level gauge guide apparatus according to claim 1, further comprising a component attached to the first facing surface and disposed below the swelling portion in the space, wherein the inclined surface is a first inclined surface, and the component includes a second inclined surface inclined toward the second facing surface so as to guide the oil level gauge to the gauge passage.

5. The oil level gauge guide apparatus according to claim 4, wherein the second inclined surface is formed so as to offset from the first inclined surface to a side of the second facing surface.

6. The oil level gauge guide apparatus according to claim 1, wherein the moving part is a band-shaped member extended in the vertical direction to transmit a torque output from the body.

7. The oil level gauge guide apparatus according to claim 1, wherein the inclined surface is formed in a curved concave shape.

* * * * *